US006027847A

United States Patent [19]

Wilson et al.

[11] Patent Number: 6,027,847

[45] Date of Patent: Feb. 22, 2000

[54] POLY(VINYLBENZYL QUATERNARY PHOSHONIUM) SALT CHARGE CONTROL AGENTS

[75] Inventors: John C. Wilson, Rochester; Dinesh Tyagi, Fairport, both of N.Y.

[73] Assignee: Eastman Kodak Company, Rochester, N.Y.

[21] Appl. No.: 09/096,109

[22] Filed: Jun. 11, 1998

[51] Int. Cl.[7] ..... G03G 9/097

[52] U.S. Cl. ..... 430/110; 430/108; 526/274

[58] Field of Search ..... 526/288, 274; 430/109, 110, 108

[56] References Cited

U.S. PATENT DOCUMENTS

| | | | |
|---|---|---|---|
| 4,496,643 | 1/1985 | Wilson et al. | 430/110 |
| 4,537,848 | 8/1985 | Yourd, III et al. | 430/110 |
| 5,561,020 | 10/1996 | Wilson et al. | 430/110 |
| 5,874,194 | 2/1999 | Wilson et al. | 430/110 |

*Primary Examiner*—John Goodrow
*Attorney, Agent, or Firm*—John R. Everett

[57] ABSTRACT

A poly(vinylbenzyl quaternary phosphonium) salt having the following general structure:

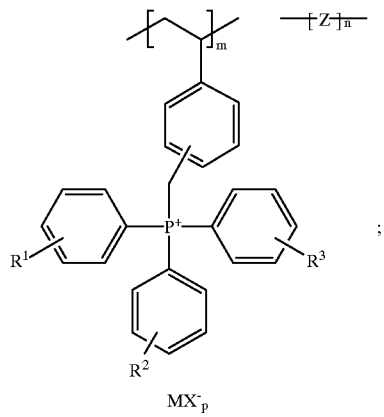

;

wherein

M represents Fe or Zn;

X represents F, Cl, Br or I;

p is 3 when M represents Zn and p is 4 when M represents Fe;

ortho, meta and para isomers of the vinyl benzyl moiety are included;

$R^1$, $R^2$ and $R^3$ represent hydrogen; alkyl having from 1 to 24 carbon atoms; hydroxy-; carboxy-; alkoxy-; carboalkoxy; acyloxy-; amino-; nitro-; cyano-; keto-; or halo-; and $R^1$, $R^2$ and $R^3$ may be independently substituted in the ortho, meta or para positions. $R^1$, $R^2$ and $R^3$ may represent more than one substituent per ring;

$\text{-}[Z]\text{-}$ represents a copolymerized comonomer selected from the group consisting of acrylamides, acrylic acid, acrylonitrile, alkyl acrylates, alkyl methacrylates, alkyl vinyl ethers, styrenes, maleic anhydride, methacrylamides, methacrylic acid, methacrylonitrile, silyl methacrylates, vinyl esters, vinyl amides and vinyl halides and m and n together total 100 mole percent wherein m is 0.01 to 100.00 mole percent.

9 Claims, No Drawings

POLY(VINYLBENZYL QUATERNARY PHOSHONIUM) SALT CHARGE CONTROL AGENTS

FIELD OF THE INVENTION

This invention relates to charge control agents for electrostatographic toners and developers.

BACKGROUND OF THE INVENTION

In electrostatography, an image comprising an electrostatic toner and field pattern, usually of non-uniform strength (also referred to as an electrostatic latent image) is formed on an insulative surface of an electrostatographic element by any of various methods. For example, the electrostatic latent image may be formed electrophotographically ( i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well-known type of electrostatographic developer comprises a dry mixture of toner particles and carrier particles. Developers of this type are commonly employed in well-known electrostatographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface. In order to meet these requirements for proper development, the level of electrostatic charge on the toner particles should be maintained within an adequate range.

The toner particles in dry developers often contain material referred to as a charge agent or a charge-control agent, which helps to establish and maintain toner charge within an acceptable range. Many types of charge-control agents have been used and are described in the published patent literature. One general type of known charge-control agent comprises a quaternary phosphonium salt. While many such salts are known, some do not perform an adequate charge-control function in any type of developer, some perform the function well in only certain kinds of developers, and some control charge well but produce adverse side effects. A number of quaternary phosphonium salt charge-control agents are described, for example, in U.S. Pat. Nos. 4, 496,643 and 4,537,848.

One of the important characteristics which is desirable for a quaternary phosphonium salt charge-control agent to possess is high thermal stability so that the salt will not totally or partially decompose during attempts to mix the salt with known toner binder materials in well-known processes of preparing toners by mixing addenda with molten toner binders. Such processes are often referred to as melt-blending or melt-compounding processes and are commonly carried out at temperatures ranging from about 120° C. to about 150° C. Thus, charge agents that are thermally unstable at temperatures at or below about 150° C. can exhibit this decomposition problem.

Another important property or characteristic for a quaternary phosphonium salt to possess is, as mentioned previously, the ability to establish toner charge within an acceptable range necessary for optimum toner development so that the quality of the image that is to be developed is ideal.

It would, therefore, be desirable to provide new, dry electrographic toners and developers containing quaternary phosphonium salts that have high thermal stability and can perform the charge-controlling function well. The present invention provides such toners and developers.

SUMMARY OF THE INVENTION

The present invention provides a poly(vinylbenzyl quaternary phosphonium) salt having the following general structure:

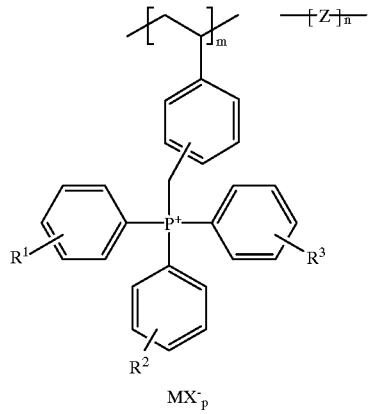

;

wherein

M represents Fe or Zn;

X represents F, Cl, Br or I;

p is 3 when M represents Zn and p is 4 when M represents Fe;

ortho, meta and para isomers of the vinyl benzyl moiety are included;

$R^1$, $R^2$ and $R^3$ represent hydrogen; alkyl having from 1 to 24 carbon atoms; hydroxy-; carboxy-; alkoxy-; carboalkoxy; acyloxy-; amino-; nitro-; cyano-; keto-; or halo-; and $R^1$, $R^2$ and $R^3$ may be independently substituted in the ortho, meta or para positions. $R^1$, $R^2$ and $R^3$ may represent more than one substituent per ring;

$\vdash Z \dashv$ represents a copolymerized comonomer selected from the group consisting of acrylamides, acrylic acid, acrylonitrile, alkyl acrylates, alkyl methacrylates, alkyl vinyl ethers, styrenes, maleic anhydride, methacrylamides, methacrylic acid, methacrylonitrile, silyl methacrylates, vinyl esters, vinyl amides and vinyl halides and m and n together total 100 mole percent wherein m is 0.01 to 100.00 mole percent.

These polymer salts provide good charge-control in electrographic toners and developers. The quaternary phosphonium tetrahaloferrate and trihalozincate moieties responsible for charge control have enhanced activity when bound in the polymer backbone structure compared to quaternary phosphonium tetrahaloferrate and trihalozincate salts disclosed in U.S. Pat. Nos.5,459,006 and 5,561,020. They are also less fugitive in toners than quaternary phosphonium tetrahaloferrate and trihalozincate salts disclosed in U.S. Pat. Nos. 5,459,006 and 5,561,020. The thermal stabilities of the copolymers are significantly greater than compounding temperatures or fusing temperatures thereby minimizing concern over formation of toxic degradation products during melt compounding of toner or during heat fusing of toner to receiver.

DETAILED DESCRIPTION OF THE INVENTION

A particularly useful group of salts according to the above structure are where:

$R^1$, $R^2$ and $R^3$ represent hydrogen; alkyl having from 1 to 24 carbon atoms such as methyl, ethyl, n-propyl, 2-propyl, n-butyl, 2-butyl, n-pentyl, 3-pentyl, 2-ethylhexyl, cyclohexyl, n-octadecyl, and the like; hydroxy-; carboxy-; alkoxy-; such as methoxy, ethoxy, propoxy, butoxy, tert-butoxy, decyloxy and the like; carboalkoxy such as carbomethoxy, carboethoxy, carbobutoxy and the like, acyloxy such as acetoxy and benzoyloxy; amino such as unsubstituted amino, methylamino, diethylamino, phenylamino and the like; nitro; cyano; keto such as acetyl, benzoyl, propionyl, butyryl, hexanoyl and the like; or halo such as fluoro, chloro, bromo or iodo;

$\vdash Z \dashv$ represents a copolymerized comonomer selected from the group consisting of acrylamide, acrylic acid, acrylonitrile, benzyl methacrylate, n-butyl acrylate, t-butyl acrylate, n-butyl vinyl ether, 4-chloromethylstyrene, cyclohexyl acrylate, n-decyl methacrylate, 2-diethylaminoethyl acrylate, 2-dimethylaminoethyl methacrylate, ethyl acrylate, 2-ethylhexyl acrylate, 2-hydroxyethyl acrylate, isobornyl methacrylate, isobutyl vinyl ether, lauryl methacrylate, maleic anhydride, methacrylamide, methacrylic acid, methacrylonitrile, methyl methacrylate, styrene, α-methylstyrene, 4-methylstyrene, 4-t-butylstyrene, n-octadecyl acrylate, 2-phenylethyl methacrylate, tetrahydrofurfuryl acrylate, trimethylsilyl methacrylate, vinyl acetate, vinyl caprolactam, vinylidene chloride and N-vinyl-2-pyrrolidone; and m is 1.00 to 10.00 mole percent.

Poly(vinylbenzyl quaternary phosphonium tetrahaloferrate) and poly(vinylbenzyl quaternary phosphonium trihalozincate) salts of the invention are prepared by a three step process (Scheme I). Vinylbenzyl quaternary phosphonium halide is prepared by quaternization of triaryl phosphine with vinylbenzyl halide. The second step requires the polymerization or copolymerization with another comonomer to give polymer I. Step three involves dissolving polymer I in a solvent and pouring the resultant polymer solution into a methanolic solution of metal halide to give a precipitate of polymer II. Optionally and less preferred, the polymers could also be prepared by polymerization of vinylbenzyl halide followed by quaternization with triarylphosphine and treatment with metal halide. A third option involving treatment of vinylbenzyl quaternary phosphonium halide with metal halide to give vinylbenzyl quaternary phosphonium tetrahaloferrate and trihalozincate and subsequent polymerization is least desirable owing to the tendencies of certain halometallic anions to inhibit free radical initiated polymerization.

Scheme I

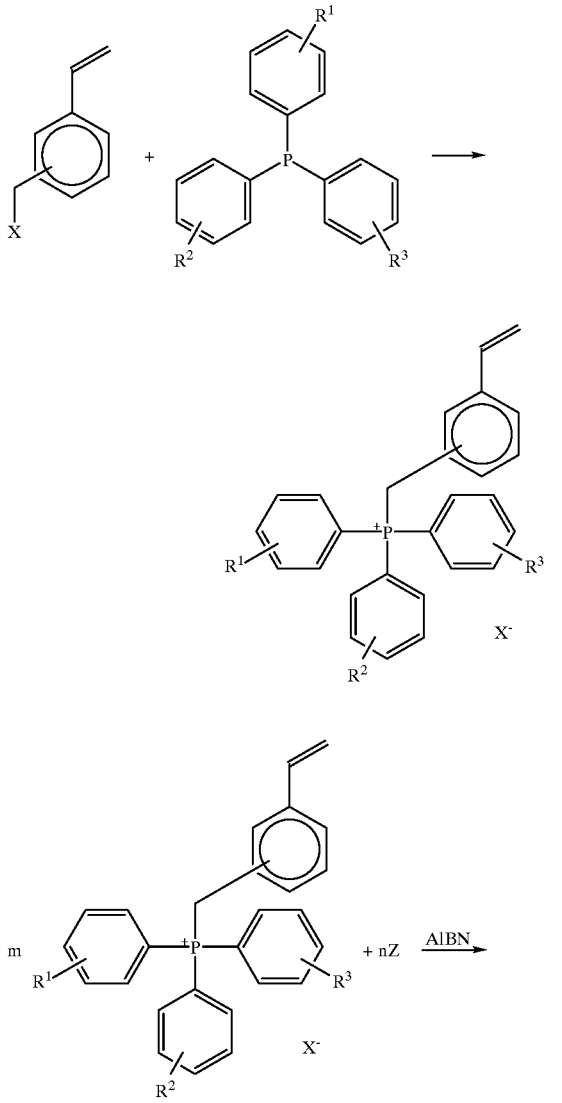

-continued

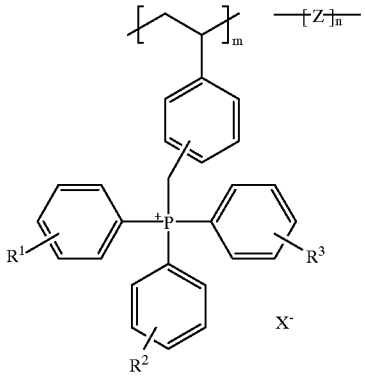

I

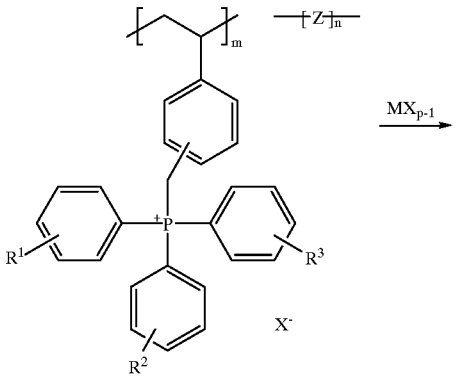

I

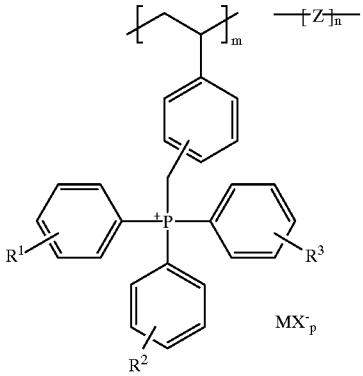

II

The above method of preparation is illustrated in detail in Examples 1 and 2.

EXAMPLE 1

Preparation of Copoly[4-vinylbenzyl triphenylphosphonium tetrachloroferrate:styrene] 2.7:97.3 mol %

Step 1—Preparation of 4-vinylbenzyltriphenylphosphonium chloride

4-Vinylbenzyl triphenylphosphonium chloride was prepared as described by Ruckenstein and Hong, Macromolecules, 26(6), 1363(1993).

A solution of 85.00 g (557 mmol) of 4-vinylbenzyl chloride, 146.10 g (557 mmol) of triphenylphosphine, 4-t-butylpyrocatechol inhibitor and 800 ml of DMF was heated in a 60° C. bath under nitrogen for 23 hrs and cooled. Ether (100 ml) was added after which precipitation of product commenced. The mixture was allowed to stand overnight and filtered. The solid was washed with ether and ligroine and then dried.

Step 2—Preparation of Copoly[4-vinylbenzyl triphenylphosphonium chloride:styrene] 2.7:97.3 mol %

A solution of 10.00 g (24.1 mmol) of 4-vinylbenzyl triphenylphosphonium chloride (prepared as described above), 90.00 g (864.1 mmol) of styrene and 100.00 g of DMF was purged with nitrogen in a 60° C. bath. AIBN (0.50 g) was added and the solution was heated under nitrogen in a 60° C. bath for 65.5 hrs. The polymer was precipitated in isopropanol, isolated, rinsed again with isopropanol and redissolved in methylene chloride. The polymer was reprecipitated in ligroine, isolated, rinsed again with ligroine and dried. The yield of polymer was 69.58 g (69.58% conversion).

Step 3—Preparation of Copoly[4-vinylbenzyltriphenylphosphonium tetrachloroferrate:styrene] 2.7:97.3 mol %

A solution of 6.50 g (1.57 meq of $Cl^-$) of copoly[4-vinylbenzyl triphenylphosphonium chloride:styrene] 2.7:97.3 mol % (prepared as described above) in 35 ml of methylene chloride was added to a filtered solution of 2.12 g (13.08 mmol) of ferric chloride in 210 ml of anhydrous methanol. The polymer which precipitated was collected, washed with methanol and dried. The yield of polymer was 6.00 g.

EXAMPLE 2

Preparation of Copoly[4-vinylbenzyl triphenylphosphonium trichlorozincate:styrene] 2.7:97.3 mol %

A solution of 10.00 g (2.41 meq of $Cl^-$) of copoly[4-vinylbenzyl triphenylphosphonium chloride:styrene] 2.7:97.3 mol % (prepared as described above) in 25 ml of methylene chloride was added to a solution of 2.73 g (20.00 mmol) of zinc chloride in 150 ml of methanol. The polymer which precipitated was collected, washed with methanol and dried. The yield of polymer was 6.95 g. Table I lists tetrachloroferrate and trichlorozincate copolymers prepared from copoly[4-vinylbenzyl triphenylphosphonium chloride: styrene] 2.7:97.3.

Table I

Copoly [4-vinylbenzyltriphenylphosphonium Tetrachloroferrate and Trichlorozincate:styrene] 2.7:97.3

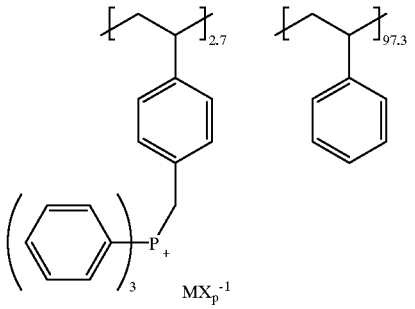

where $MX_p^{-1}$ represents $FeCl_4^{-1}$ or $ZnCl_3^{-1}$.

Other polymer charge control agents of the invention that can be prepared by the methods of Examples 1 and 2 are listed below.

poly[4-vinylbenzyl triphenylphosphonium tetrachloroferrate]

copoly[4-vinylbenzyl triphenylphosphonium tetrachloroferrate:styrene] 50:50 copoly[4-vinylbenzyl triphenylphosphonium tetrachloroferrate:methyl methacrylate] 5:95;

copoly[4-vinylbenzyl triphenylphosphonium tetrachloroferrate:acrylamide] 5:95 copoly[4-vinylbenzyl triphenylphosphonium tetrachloroferrate:methyl vinyl ether] 5:95;

copoly[4-vinylbenzyl triphenylphosphonium tetrachloroferrate:methacrylonitrile] 5:95;

copoly[4-vinylbenzyl triphenylphosphonium tetrabromoferrate:styrene] 10:90;

copoly[4-vinylbenzyl triphenylphosphonium tribromochloroferrate:styrene] 2.7:97.3;

copoly[3-vinylbenzyl triphenylphosphonium tetrachloroferrate:styrene] 2.7:97.3;

copoly[2-vinylbenzyl triphenylphosphonium tetrachloroferrate:styrene] 2.7:97.3;

copoly[4-vinylbenzyl bis(4-carbomethoxyphenyl) phenylphosphonium tetrachloroferrate:styrene] 2.7:97.3;

copoly[4-vinylbenzyl bis(4-acetoxyphenyl) phenylphosphonium tetrachloroferrate:styrene] 2.7:97.3;

copoly[4-vinylbenzyl tris(4-acetoxyphenyl)phosphonium tetrachloroferrate:styrene] 2.7:97.3;

copoly[4-vinylbenzyl tris(4-methoxyphenyl)phosphonium tetrachloroferrate:styrene] 2.7:97.3;

copoly[4-vinylbenzyl tri(4-tolyl)phosphonium tetrachloroferrate:styrene] 2.7:97.3;

copoly[4-vinylbenzyl tris(4-chlorophenyl)phosphonium tetrachloroferrate:styrene] 2.7:97.3];

copoly[4-vinylbenzyl tris(4-carbomethoxyphenyl) phosphonium tetrachloroferrate:styrene] 2.7:97.3;

copoly[4-vinylbenzyl (4-acetoxyphenyl) diphenylphosphonium tetrachloroferrate:styrene] 2.7:97.3;

copoly[4-vinylbenzyl [3,5-bis(carbomethoxy)phenyl] diphenylphosphonium tetrachloroferrate:styrene] 2.7:97.3;

poly[4-vinylbenzyl triphenylphosphonium trichlorozincate]

copoly[4-vinylbenzyl triphenylphosphonium trichlorozincate:styrene] 50:50;

copoly[4-vinylbenzyl triphenylphosphonium trichlorozincate:methyl methacrylate] 5:95;

copoly[4-vinylbenzyl triphenylphosphonium trichlorozincate:acrylamide] 5:95;

copoly[4-vinylbenzyl triphenylphosphonium trichlorozincate:methyl vinyl ether] 5:95;

copoly[4-vinylbenzyl triphenylphosphonium trichlorozincate:methacrylonitrile] 5:95;

copoly[4-vinylbenzyl triphenylphosphonium dichlorobromozincate:styrene] 5:95;

copoly[4-vinylbenzyl triphenylphosphonium tribromozincate:styrene] 10:90 copoly[4-vinylbenzyl triphenylphosphonium dibromochlorozincate:styrene] 2.7:97.3 copoly[3-vinylbenzyl triphenylphosphonium trichlorozincate:styrene] 2.7:97.3 copoly[2-vinylbenzyl triphenylphosphonium trichlorozincate:styrene] 2.7:97.3 copoly[4-vinylbenzyl bis(4-carbomethoxyphenyl) phenylphosphonium trichlorozincate:styrene] 2.7:97.3;

copoly[4-vinylbenzyl bis(4-acetoxyphenyl) phenylphosphonium trichlorozincate:styrene] 2.7:97.3;

copoly[4-vinylbenzyl tris(4-acetoxyphenyl)phosphonium trichlorozincate:styrene] 2.7:97.3;

copoly[4-vinylbenzyl tris(4-methoxyphenyl)phosphonium trichlorozincate:styrene] 2.7:97.3;

copoly[4-vinylbenzyl tri(4-tolyl)phosphonium trichlorozincate:styrene] 2.7:97.3;

copoly[4-vinylbenzyl tris(4-chlorophenyl)phosphonium trichlorozincate:styrene] 2.7:97.3;

copoly[4-vinylbenzyl tris(4-carbomethoxyphenyl) phosphonium trichlorozincate:styrene] 2.7:97.3;

copoly[4-vinylbenzyl (4-acetoxyphenyl) diphenylphosphonium trichlorozincate:styrene] 2.7:97.3 and copoly[4-vinylbenzyl [3,5-bis(carbomethoxy)phenyl] diphenylphosphonium trichlorozincate:styrene] 2.7:97.3.

To be utilized as a charge-control agent in the electrostatographic toners of the invention, the quaternary phosphonium salt is mixed in any convenient manner (preferably by melt-blending) with an appropriate polymeric toner binder material and any other desired addenda, and the mix is then ground to desired size to form a free-flowing powder of toner particles containing the charge agent. Other methods include those well-known in the art such as spray drying, melt dispersion and dispersion polymerization.

Toner particles of the invention have an average diameter between about 0.1 $\mu$m and about 100 $\mu$m, a value in the range from about 1.0 to about 30 $\mu$m being preferable for many currently used machines. However, larger or smaller particles may be needed for particular methods of development or development conditions.

Generally, it has been found desirable to add from about 0.05 to about 6 parts and preferably 2.0 to about 5.0 parts by weight of the aforementioned quaternary phosphonium tetrahaloferrate and trihalozincate salts per 100 parts by weight of a polymer to obtain the improved toner compositions of the present invention. Of course, it must be recognized that the optimum amount of charge-control agent to be added will depend, in part, on the particular quaternary phosphonium charge-control agent selected and the particular polymer to which it is added. The polymeric charge-control agents may also serve as the toner binder. However, the amounts specified hereinabove are typical of the useful range of charge-control agents utilized in conventional dry toner materials.

The polymers useful as toner binders in the practice of the present invention can be used alone or in combination and include those polymers conventionally employed in electrostatic toners. Useful amorphous polymers generally have a glass transition temperature within the range of from 50° to 120° C. Preferably, toner particles prepared from these polymers have relatively high caking temperature, for example, higher than about 60° C., so that the toner powders can be stored for relatively long periods of time at fairly high temperatures without having individual particles agglomerate and clump together. The melting point of useful crystalline polymers preferably is within the range of from about 65° C. to about 200° C. so that the toner particles can readily be fused to a conventional paper receiving sheet to form a permanent image. Especially preferred crystalline polymers are those having a melting point within the range of from about 65° to about 120° C. Of course, where other types of receiving elements are used, for example, metal plates such as certain printing plates, polymers having a melting point or glass transition temperature higher than the values specified above can be used.

The various polymers which can be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers as described in Re. U.S. Pat. No. 31,072.

Typical useful toner polymers include certain polycarbonates such as those described in U.S. Pat. No. 3,694,359, which include polycarbonate materials containing an alkylidene diarylene moiety in a recurring unit and having from 1 to about 10 carbon atoms in the alkylidene moiety. Other useful polymers having the above-described physical properties include polymeric esters of acrylic and methacrylic acid such as poly(alkyl acrylate), and poly(alkyl methacrylate) wherein the alkyl moiety can contain from 1 to about 10 carbon atoms. Additionally, other polyesters having the aforementioned physical properties are also useful. Among such other useful polyesters are copolyesters prepared from terephthalic acid (including substituted terephthalic acid), fumaric acid, a bis[(hydroxyalkoxy) phenyl]alkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety.

Other useful polymers are various styrene-containing polymers. Such polymers can comprise, e.g., a polymerized blend of from about 40 to about 100 percent by weight of styrene, from 0 to about 45 percent by weight of a lower alkyl acrylate or methacrylate having from 1 to 4 carbon atoms in the alkyl moiety such as methyl, ethyl, isopropyl, butyl, etc. and from about 5 to about 50 percent by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described herein-above are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate (e.g., styrene-butyl acrylate-ethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. Nos. 2,917,460; Re. U.S. Pat. Nos. 25,316; 2,788,288; 2,638,416; 2,618,552 and 2,659,670.

Various kinds of well-known addenda (e.g., colorants, release agents, etc.) can also be incorporated into the toners of the invention.

Numerous colorant materials selected from dyestuffs or pigments can be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index Volumes 1 and 2, Second Edition. Included among the vast number of useful colorants are such materials as Hansa Yellow G (C.I. 11680), Nigrosine Spirit soluble (C.I. 50415), Chromogen Black ET00 (C.I. 45170), Solvent Black 3 (C.I. 26150), Fuchsine N (C.I. 42510), C.I. Basic Blue 9 (C.I. 52015). Carbon black also provides a useful colorant. The amount of colorant added may vary over a wide range, for example, from about 1 to about 20 percent of the weight of the polymer. Particularly good results are obtained when the amount is from about 1 to about 10 percent.

To be utilized as toners in the electrostatographic developers of the invention, the toners of this invention can be mixed with a carrier vehicle. The carrier vehicles, which can be used with the present toners to form the new developer compositions, can be selected from a variety of materials. Such materials include carrier core particles and core particles overcoated with a thin layer of a film-forming resin.

The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060.

As noted above, the carrier particles can be overcoated with a thin layer of a film-forming resin for the purpose of establishing the correct triboelectric relationship and charge level with the toner employed. Examples of suitable resins are the polymers described in U.S. Pat. Nos. 3, 547,822; 3,632,512; 3,795,618; 3,898,170 and Belgian Pat. No. 797, 132. Other useful resins are fluorocarbons such as polytetrafluoroethylene, poly(vinylidene fluoride), mixtures of these and copolymers of vinylidene fluoride and tetrafluoroethylene. See, for example, U.S. Pat. Nos. 4,545,060; 4,478,925; 4,076,857; and 3,970,571. Such polymeric fluorocarbon carrier coatings can serve a number of known purposes. One such purpose can be to aid the developer to meet the electrostatic force requirements mentioned above by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

A typical developer composition containing the above-described toner and a carrier vehicle generally comprises from about 1 to about 20 percent by weight of particulate toner particles and from about 80 to about 99 percent by weight carrier particles. Usually, the carrier particles are larger than the toner particles. Conventional carrier particles have a particle size on the order of from about 20 to about 1200 micrometers, preferably 30–300 micrometers.

Alternatively, the toners of the present invention can be used in a single component developer, i.e., with no carrier particles.

The charge-control agents of the present invention impart a positive charge to the toner composition. The level of charge on the developer compositions utilizing a charge-control agent of the present invention is preferably in the range of from about 15 to 60 microcoulombs per gram of toner for toner particles having a volume average diameter of from about 7 to 15 micrometers in the developer as determined in accordance with the procedure described below.

The toner and developer compositions of this invention can be used in a variety of ways to develop electrostatic charge patterns or latent images. Such developable charge patterns can be prepared by a number of means and be carried for example, on a light sensitive photoconductive element or a non-light-sensitive dielectric-surfaced element such as an insulator-coated conductive sheet. One suitable development technique involves cascading the developer composition across the electrostatic charge pattern, while another technique involves applying toner particles firm a magnetic brush. This latter technique involves the use of a magnetically attractable carrier vehicle in forming the developer composition. After imagewise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image.

The following examples are presented to further illustrate the present invention.

Toner Preparation

Toners were formulated by compounding 100 parts of cross-linked styrene/n-butyl acrylate copolymer with 6 parts of Black Pearls 430 (Cabot Corporation, Boston Mass.) with 2 and 5 parts of the novel charge agents described above at 150° C. on a 4 inch roll mill. The toner binder consisted of styrene, n-butyl acrylate and divinyl benzene (77/23/0.3325 weight ratio). The copolymer was synthesized by a limited coalescence based suspension polymerization technique and devolatilized by an extrusion method.

The resultant melt compounded product was pulverized in a fluid energy mill to yield a volume average particle size of about 12 microns as measured by Coulter Counter.

Preparation of Developer

The developers were prepared by combining 10 grams of toner with 90 grams of carrier particles. The carrier consisted of strontium ferrite based core which had been melt coated at 230° C. with 2 pph of poly(vinylidene flouride) (Kynar 301F manufactured by Elf Atochem).

Evaluation of Toner Charging, Aging and Throw-Off

The charge to mass of the developer was measured by the following conventional charge measuring technique. 4 grams of the above developer was gently agitated in an appropriate bottle or vial to allow developer to reach its optimum maximum charge. This was achieved by a wrist action robot shaker operating at 2 Hz and an overall amplitude of 11 cm for 2 minutes. The toner charge was measured by placing 0.1 to 0.2 grams of charged developer in a sample dish situated between electrode plates and subjecting it simultaneously for 30 seconds to a 60 Hz magnetic field to cause developer agitation and to an electric field of about 2000 volts/cm between the plates. Some toner releases from the plate having polarity opposite to the toner charge. The total charge was measured by an electrometer connected to the plate. The toner charge divided by the weight of toner on the opposite plate yielded the charge/mass ratio for the toner in microcoulombs/gram ($\mu$C/gm).

The exercised charge/mass ratio was determined similarly except that the charged developer was vigorously aged by placing it into a plastic vial, capping the vial and placing the vial for 10 minutes on a "bottle brush" device comprising a magnetic toning roller with a stationary shell and a magnetic core rotating at 2000 rpm. The magnetic core had 12 magnetic poles arranged around its periphery in alternating north-south fashion.

The throw-off value (TO) for the toner was determined by taking the 2 gram developer sample that had been bottle-brush exercised for 10 minutes, admixing in 5 percent more toner to provide a final toner concentration of 15 percent, followed by 15 seconds of agitation on a wrist action shaker. This developer was then placed on a toning roller containing a rotating magnetic core similar to a magnetic brush used for electrostatic development. A Plexiglass™ housing contained the assembly and having a vacuum filter mounted directly over the roll with a vacuum applied to direct any toner throwoff to the vacuum filter. The weight of toner in milligrams collected on a piece of filter paper after one minute of running the magnetic core at 2000 rpm was reported as the throw-off value. The extended aging behavior of the developer was determined by placing a six gram developer on a bottle-brush for 16 hours. The aged developer was then stripped of all toner and rebuilt with fresh toner again at 10% toner concentration. The fresh exercised charge/mass values were calculated as described previously along with the throw-off results.

Tables II and III establish the utility of black toners containing the polymeric charge-control agents of the invention. The charge stability can be estimated by the relative stability of the 10 min bottle brush charge/mass values obtained on first day and after overnight exercising. Typically, the charge/mass value obtained after 2 minutes on wrist shaker, indicates the lack of preconditioning. The similar value obtained following overnight exercise is generally low due to stripping action, which leaves behind highly charged, small particles on the carrier surface.

A measure of charging rate is the amount of dusting observed when fresh toner is ad(led to a charged developer. If for any reason, the toner is unable to charge sufficiently in the short agitation period, then the centrifugal force experienced in a rotating developing brush will overcome the weak electrostatic attraction between the toner and the carrier surface and dusting will ensue.

Table II summarizes the charging behavior of copoly[4-vinylbenzyl triphenylphosphonium tetrachloroferrate:styrene] 2.7:97.3. The two critical criteria for establishing the effectiveness of any charge agent is the charge stability and the charging rate.

The copolymer sample in Table II contains 2.7 mole percent amount of 4-vinylbenzyl triphenylphosphonium tetrachloroferrate moiety. The results in Table II show that, in general, the developers containing the above copolymer exhibit fairly stable charge at both 2 and 5 pph levels. The toners formulated with 4-vinylbenzyl triphenylphosphonium tetrachloroferrate moiety as charge controlling agent maintain this charge/mass stability even after the developer is aged overnight. Further, the charge stability of the developer appears to be maintained regardless of the amount of the charge agent used. Hence, it would be possible to control the charge/mass ratio of toner by changing the charge agent amount while not affecting the long term developer charging characteristics. The dusting behavior with 4-vinylbenzyl triphenylphosphonium tetrachloroferrate is found to be excellent even when the charge/mass is low indicating a rapid charging behavior of the toner.

TABLE II

Copoly[4-vinylbenzyl triphenylphosphonium tetrachloroferrate:styrene] 2.7:97.3 Charge Control Properties

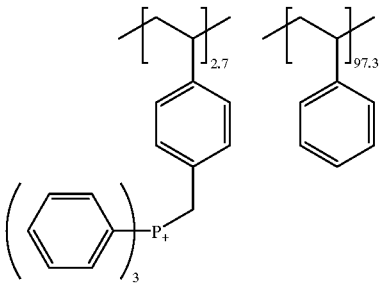

$FeCl_4^-$

| | Initial | | | Overnight, Strip & Rebuild | | |
|---|---|---|---|---|---|---|
| pph | fresh Q/m (μC/g) | 10 min Q/m (μC/g) | TO, mg | Fresh Q/m (μC/g) | 10 min Q/m (μC/g) | TO, mg |
| 2 | 53.21 | 16.30 | 4.5 | 27.63 | 22.57 | 0.9 |
| 5 | 75.91 | 49.46 | 0.3 | 46.27 | 47.86 | 0.4 |

Table III summarizes the charging behavior of copoly[4-vinylbenzyl triphenylphosphonium trichlorozincate:styrene] 2.7:97.3. The two critical criteria for establishing the effectiveness of any charge agent is the charge stability and the charging rate.

The copolymer sample in Table III contains 2.7 mole percent amount of 4-vinylbenzyl triphenylphosphonium trichlorozincate moiety. The results in Table III show that, in general, the developers containing the above moiety in copolymeric CCA exhibit fairly stable charge at both 2 and 5 pph levels. The toners formulated with 4-vinylbenzyl triphenylphosphonium trichlorozincate moiety as charge controlling agent maintain this charge/mass stability even after the developer is aged overnight. Further, the charge stability of the developer appears to be maintained regardless of the amount of the charge agent used.

Hence, it would be possible to control the charge/mass ratio of toner by changing the charge agent amount while not affecting the long term developer charging characteristics. Overall, these copolymers provide slightly higher charge than many other char,,e agent in its class. Dusting behavior with 4-vinylbenzyl triphenylphosphoniun trichlorozincate is found to be quite good even when the charge/mass is low suggesting a rapid charging behavior of the toner.

TABLE III

Copoly[4-vinylbenzyl triphenylphosphonium trichlorozincate:styrene] 2.7:97.3 Charge Control Properties

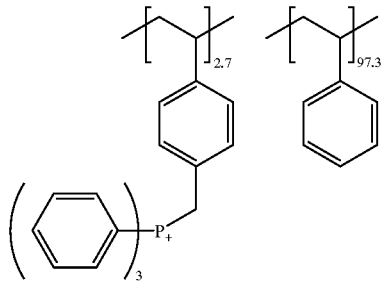

$ZnCl_3^-$

| | Initial | | | Overnight, Strip & Rebuild | | |
|---|---|---|---|---|---|---|
| pph | fresh Q/m (μC/g) | 10 min Q/m (μC/g) | TO, mg | Fresh Q/m (μC/g) | 10 min Q/m (μC/g) | TO, mg |
| 2 | 59.8 | 32.0 | 0.7 | 23.3 | 28.0 | 4.6 |
| 5 | 66.2 | 51.5 | 0.5 | 39.7 | 48.0 | 2.2 |

The invention has been described in detail with particular reference to certain preferred embodiments thereof, but it will be understood that variations and modifications can be effected within the spirit and scope of the invention.

What is claimed is:

1. A poly(vinylbenzyl quaternary phosphonium) salt having the following general structure:

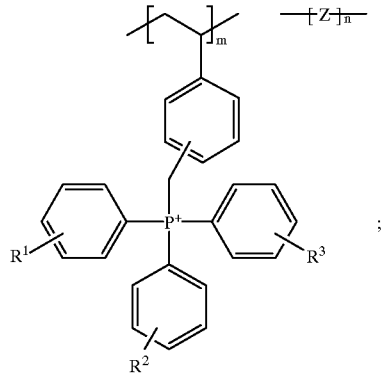

$MX^-_p$ wherein

M represents Fe or Zn;

X represents F, Cl, Br or I;

p is 3 when M represents Zn and p is 4 when M represents Fe;

ortho, meta and para isomers of the vinyl benzyl moiety are included;

$R^1$, $R^2$ and $R^3$ represent hydrogen; alkyl having from 1 to 24 carbon atoms; hydroxy-; carboxy-; alkoxy-; carboalkoxy; acyloxy-; amino-; nitro-; cyano-; keto-; or halo-; and $R^1$, $R^2$ and $R^3$ may be independently substituted in the ortho, meta or para positions. $R^1$, $R^2$ and $R^3$ may represent more than one substituent per ring;

$\text{-}[Z]\text{-}$ represents a copolymerized comonomer selected from the group consisting of acrylamides, acrylic acid, acrylonitrile, alkyl acrylates, alkyl methacrylates, alkyl vinyl ethers, styrenes, maleic anhydride, methacrylamides, methacrylic acid, methacrylonitrile, silyl methacrylates, vinyl esters, vinyl amides and vinyl halides and m and n together total 100 mole percent wherein m is 0.01 to 100.00 mole percent.

2. The salt of claim 1 wherein:

$R^1$, $R^2$ and $R^3$ represent hydrogen; alkyl having from 1 to 24 carbon atoms such as methyl, ethyl, n-propyl, 2-propyl, n-butyl, 2-butyl, n-pentyl, 3-pentyl, 2-ethylhexyl, cyclohexyl, n-octadecyl, and the like; hydroxy-; carboxy-; alkoxy- such as methoxy, ethoxy, propoxy, butoxy, tert-butoxy, decyloxy and the like; carboalkoxy such as carbomethoxy, carboethoxy, carbobutoxy and the like, acyloxy such as acetoxy and benzoyloxy; amino such as unsubstituted amino, methylamino, diethylamino, phenylamino and the like; nitro; cyano; keto such as acetyl, benzoyl, propionyl, butyryl, hexanoyl and the like; or halo such as fluoro, chloro, bromo or iodo;

$\frac{}{[Z]}$ represents a copolymerized comonomer selected from the group consisting of acrylamide, acrylic acid, acrylonitrile, benzyl methacrylate, n-butyl acrylate, t-butyl acrylate, n-butyl vinyl ether, 4-chloromethylstyrene, cyclohexyl acrylate, n-decyl methacrylate, acrylate, 2-diethylamino ethyl acrylate, 2-dimethylaminoethyl methacrylate, ethyl acrylate, 2-ethylhexyl acrylate, 2-hydroxyethyl acrylate, isobornyl methacrylate, isobutyl vinyl ether, lauryl methacrylate, maleic anhydride, methacrylamide, methacrylic acid, methacrylonitrile, methyl methacrylate, styrene, α-methylstyrene, 4-methylstyrene, 4-t-butylstyrene, n-octadecyl acrylate, 2-phenylethyl methacrylate, tetrahydrofu furyl acrylate, trimethylsilyl methacrylate, vinyl acetate, vinyl caprolactam, vinylidene chloride and N-vinyl-2-pyrrolidone; and m is 1.00 to 10.00 mole percent.

3. The salt of claim 2 selected from the group consisting of:

poly[4-vinylbenzyl triphenylphosphonium tetrachloroferrate]

copoly[4-vinylbenzyl triphenylphosphonium tetrachloroferrate:styrene] 50:50 copoly[4-vinylbenzyl triphenylphosphonium tetrachloroferrate:methyl methacrylate] 5:95;

copoly[4-vinylbenzyl triphenylphosphonium tetrachloroferrate:acrylamide] 5:95 copoly[4-vinylbenzyl triphenylphosphonium tetrachloroferrate:methyl vinyl ether] 5:95;

copoly[4-vinylbenzyl triphenylphosphonium tetrachloroferrate:methacrylonitrile] 5:95;

copoly[4-vinylbenzyl triphenylphosphonium tetrabromoferrate:styrene] 10:90;

copoly[4-vinylbenzyl triphenylphosphonium tribromochloroferrate:styrene] 2.7:97.3;

copoly[3-vinylbenzyl triphenylphosphonium tetrachloroferrate:styrene] 2.7:97.3;

copoly[2-vinylbenzyl triphenylphosphonium tetrachloroferrate:styrene] 2.7:97.3;

copoly[4-vinylbenzyl bis(4-carbomethoxyphenyl) phenylphosphonium tetrachloroferrate:styrene] 2.7:97.3;

copoly[4-vinylbenzyl bis(4-acetoxyphenyl) phenylphosphonium tetrachloroferrate:styrene] 2.7:97.3;

copoly[4-vinylbenzyl tris(4-acetoxyphenyl)phosphonium tetrachloroferrate:styrene] 2.7:97.3;

copoly[4-vinylbenzyl tris(4-methoxyphenyl)phosphonium tetrachloroferrate:styrene] 2.7:97.3;

copoly[4-vinylbenzyl tri(4-tolyl)phosphonium tetrachloroferrate:styrene] 2.7:97.3;

copoly[4-vinylbenzyl tris(4-chlorophenyl)phosphonium tetrachloroferrate:styrene] 2.7:97.3];

copoly[4-vinylbenzyl tris(4-carbomethoxyphenyl) phosphonium tetrachloroferrate:styrene] 2.7:97.3;

copoly[4-vinylbenzyl (4-acetoxyphenyl) diphenylphosphonium tetrachloroferrate:styrene] 2.7:97.3;

copoly[4-vinylbenzyl [3,5-bis(carbomethoxy)phenyl] diphenylphosphonium tetrachloroferrate:styrene] 2.7:97.3;

poly[4-vinylbenzyl triphenylphosphonium trichlorozincate]

copoly[4-vinylbenzyl triphenylphosphonium trichlorozincate:styrene] 50:50;

copoly[4-vinylbenzyl triphenylphosphonium trichlorozincate:methyl methacrylate] 5:95;

copoly[4-vinylbenzyl triphenylphosphonium trichlorozincate:acrylamide] 5:95;

copoly[4-vinylbenzyl triphenylphosphonium trichlorozincate:methyl vinyl ether] 5:95;

copoly[4-vinylbenzyl triphenylphosphonium trichlorozincate:methacrylonitrile] 5:95;

copoly[4-vinylbenzyl triphenylphosphonium dichlorobromozincate:styrene] 5:95;

copoly[4-vinylbenzyl triphenylphosphonium tribromozincate:styrene] 10:90 copoly[4-vinylbenzyl triphenylphosphonium dibromochlorozincate:styrene] 2.7:97.3 copoly[3-vinylbenzyl triphenylphosphonium trichlorozincate:styrene] 2.7:97.3 copoly[2-vinylbenzyl triphenylphosphonium trichlorozincate:styrene] 2.7:97.3 copoly[4-vinylbenzyl bis(4-carbomethoxyphenyl) phenylphosphonium trichlorozincate:styrene] 2.7:97.3;

copoly[4-vinylbenzyl bis(4-acetoxyphenyl) phenylphosphonium trichlorozincate:styrene] 2.7:97.3;

copoly[4-vinylbenzyl tris(4-acetoxyphenyl)phosphonium trichlorozincate:styrene] 2.7:97.3;

copoly[4-vinylbenzyl tris(4-methoxyphenyl)phosphonium trichlorozincate:styrene] 2.7:97.3;

copoly[4-vinylbenzyl tri(4-tolyl)phosphonium trichlorozincate:styrene] 2.7:97.3;

copoly[4-vinylbenzyl tris(4-chlorophenyl)phosphonium trichlorozincate:styrene] 2.7:97.3;

copoly[4-vinylbenzyl tris(4-carbomethoxyphenyl) phosphonium trichlorozincate:styrene] 2.7:97.3;

copoly[4-vinylbenzyl (4-acetoxyphenyl) diphenylphosphonium trichlorozincate:styrene] 2.7:97.3 and copoly[4-vinylbenzyl [3,5-bis(carbomethoxy)phenyl] diphenylphosphonium trichlorozincate:styrene] 2.7:97.3.

4. The salt of claim 2 selected from the group consisting of:

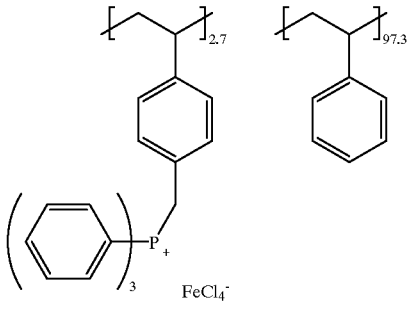

and

-continued

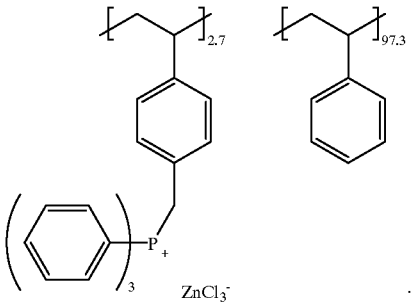

5. An electrostatographic developer comprising a toner having polymeric binder and a poly(vinylbenzyl quaternary phosphonium) salt charge control agent having the structure:

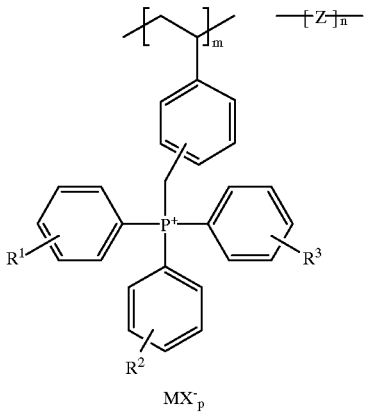

M represents Fe or Zn;

X represents F, Cl, Br or I;

p is 3 when M represents Zn and p is 4 when M represents Fe;

ortho, meta and para isomers of the vinyl benzyl moiety are included;

$R^1$, $R^2$ and $R^3$ represent hydrogen; alkyl having from 1 to 24 carbon atoms; hydroxy-; carboxy-; alkoxy-; carboalkoxy; acyloxy-; amino-; nitro-; cyano-; keto-; or halo-; and $R^1$, $R^2$ and $R^3$ may be independently substituted in the ortho, meta or para positions. $R^1$, $R^2$ and $R^3$ may represent more than one substituent per ring;

-[Z]- represents a copolymerized comonomer selected from the group consisting of acrylamides, acrylic acid, acrylonitrile, alkyl acrylates, alkyl methacrylates, alkyl vinyl ethers, styrenes, maleic anhydride, methacrylamides, methacrylic acid, methacrylonitrile, silyl methacrylates, vinyl esters, vinyl amides and vinyl halides and m and n together total 100 mole percent wherein m is 0.01 to 100.00 mole percent.

6. The electrostatographic toner of claim 5 wherein $R^1$, $R^2$ and $R^3$ represent hydrogen; alkyl having from 1 to 24 carbon atoms such as methyl, ethyl, n-propyl, 2-propyl, n-butyl, 2-butyl, n-pentyl, 3-pentyl, 2-ethylhexyl, cyclohexyl, n-octadecyl, and the like; hydroxy-; carboxy-; alkoxy- such as methoxy, ethoxy, propoxy, butoxy, tert-butoxy, decyloxy and the like; carboalkoxy such as carbomethoxy, carboethoxy, carbobutoxy and the like, acyloxy such as acetoxy and benzoyloxy; amino such as unsubstituted amino, methylamino, diethylamino, phenylamino and the like; nitro; cyano; keto such as acetyl, benzoyl, propionyl, butyryl, hexanoyl and the like; or halo such as fluoro, chloro, bromo or iodo;

-[Z]- represents a copolymerized comonomer selected from the group consisting of acrylamide, acrylic acid, acrylonitrile, benzyl methacrylate, n-butyl acrylate, t-butyl acrylate, n-butyl vinyl ether, 4-chloromethylstyrene, cyclohexyl acrylate, n-decyl methacrylate, 2-diethylaminoethyl acrylate, 2-dimethylaminoethyl methacrylate, ethyl acrylate, 2-ethylhexyl acrylate, 2-hydroxyethyl acrylate, isobornyl methacrylate, isobutyl vinyl ether, lauryl methacrylate, maleic anhydride, methacrylamide, methacrylic acid, methacrylonitrile, methyl methacrylate, styrene, o-methylstyrene, 4-methylstyrene, 4-t-butylstyrene, n-octadecyl acrylate, 2-phenylethyl methacrylate, tetrahydrofu furyl acryl ate, trimethylsilyl methacrylate, vinyl acetate, vinyl caprolactam, vinylidene chloride and N-vinyl-2-pyrrolidone; and m is 1.00 to 10.00 mole percent.

7. The electrostatographic toner of claim 5 wherein the salt is selected from the group consisting of:

poly[4-vinyl benzyl triphenylphosphonium tetrachloroferrate]

copoly[4-vinylbenzyl triphenylphosphonium tetrachloroferrate:styrene] 50:50 copoly[4-vinylbenzyl triphenylphosphonium tetrachloroferrate:methyl methacrylate] 5:95;

copoly[4-vinylbenzyl triphenylphosphonium tetrachloroferrate:acrylamide] 5:95 copoly[4-vinylbenzyl triphenylphosphonium tetrachloroferrate:methyl vinyl ether] 5:95;

copoly[4-vinylbenzyl triphenylphosphonium tetrachloroferrate:methacrylonitrile] 5:95;

copoly[4-vinylbenzyl triphenylphosphonium tetrabromoferrate:styrene] 10:90;

copoly[4-vinylbenzyl triphenylphosphonium tribromochloroferrate:styrene] 2.7:97.3;

copoly[3-vinylbenzyl triphenylphosphonium tetrachloroferrate:styrene] 2.7:97.3;

copoly[2-vinylbenzyl triphenylphosphonium tetrachloroferrate:styrene] 2.7:97.3;

copoly[4-vinylbenzyl bis(4-carbomethoxyphenyl) phenylphosphonium tetrachloroferrate :styrene] 2.7:97.3;

copoly[4-vinylbenzyl bis(4-acetoxyphenyl) phenylphosphonium tetrachloroferrate:styrene] 2.7:97.3;

copoly[4-vinylbenzyl tris(4-acetoxyphenyl)phosphonium tetrachloroferrate:styrene] 2.7:97.3;

copoly[4-vinylbenzyl tris(4-methoxyphenyl)phosphonium tetrachloroferrate:styrene] 2.7:97.3;

copoly[4-vinylbenzyl tri(4-tolyl)phosphonium tetrachloroferrate:styrene] 2.7:97.3;

copoly[4-vinylbenzyl tris(4-chlorophenyl)phosphonium tetrachloroferrate:styrene] 2.7:97.3];

copoly[4-vinylbenzyl tris(4-carbomethoxyphenyl) phosphonium tetrachlorofcirate:styrene] 2.7:97.3;

copoly[4-vinylbenzyl (4-acetoxyphenyl) diphenylphosphonium tetrachloroferrate:styrene] 2.7:97.3;

copoly[4-vinylbenzyl [3,5-bis(carbomethoxy)phenyl] diphenylphosphonium tetrachloroferrate:styrene] 2.7:97.3;

poly[4-vinylbenzyl triphenylphosphonium trichlorozincate]

copoly[4-vinylbenzyl triphenylphosphonium trichlorozincate:styrene] 50:50;

copoly[4-vinylbenzyl triphenylphosphonium trichlorozincate:methyl methacrylate] 5:95;

copoly[4-vinylbenzyl triphenylphosphonium trichlorozincate:acrylamide] 5:95;

copoly[4-vinylbenzyl triphenylphosphonium trichlorozincate:methyl vinyl ether] 5:95;

copoly[4-vinylbenzyl triphenylphosphonium trichlorozincate:methacrylonitrile] 5:95;

copoly[4-vinylbenzyl triphenylphosphonium dichlorobromozincate:styrene] 5:95;

copoly[4-vinylbenzyl triphenylphosphonium tribromozincate:styrene] 10:90 copoly[4-vinylbenzyl triphenylphosphonium dibromochlorozincate:styrene] 2.7:97.3 copoly[3-vinylbenzyl triphenylphosphonium trichlorozincate:styrene] 2.7:97.3 copoly[2-vinylbenzyl triphenylphosphonium trichlorozincate:styrene] 2.7:97.3 copoly[4-vinylbenzyl bis(4-carbomethoxyphenyl) phenylphosphonium trichlorozincate:styrene] 2.7:97.3;

copoly[4-vinylbenzyl bis(4-acetoxyphenyl) phenylphosphonium trichlorozincate:styrene] 2.7:97.3;

copoly[4-vinylbenzyl tris(4-acetoxyphenyl)phosphonium trichlorozincate:styrene] 2.7:97.3;

copoly[4-vinylbenzyl tris(4-methoxyphenyl)phosphonium trichlorozincate:styrene] 2.7:97.3;

copoly[4-vinylbenzyl tri(4-tolyl)phosphonium trichlorozincate:styrene] 2.7:97.3;

copoly[4-vinylbenzyl tris(4-chlorophenyl)phosphonium trichlorozincate:styrene] 2.7:97.3;

copoly[4-vinylbenzyl tris(4-carbomethoxyphenyl) phosphonium trichlorozincate:styrene] 2.7:97.3;

copoly[4-vinylbenzyl (4-acetoxyphenyl) diphenylphosphonium trichlorozincate:styrene] 2.7:97.3 and copoly[4-vinylbenzyl [3,5-bis(carbomethoxy)phenyl] diphenylphosphonium trichlorozincate:styrene] 2.7:97.3.

8. The electrostatographic toner of claim 5 wherein the salt is selected from the group consisting of:

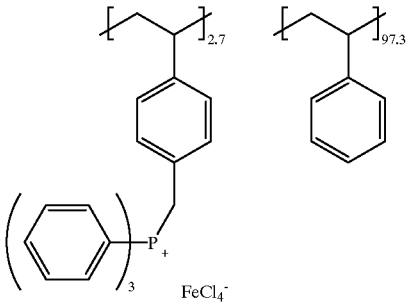

and

-continued

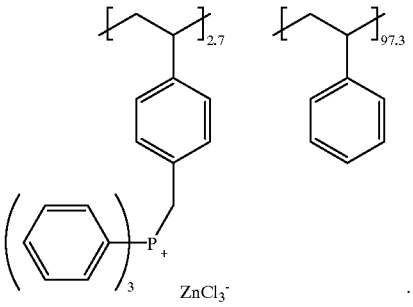

9. An electrostatographic developer comprising a carrier, a toner having polymeric binder and a poly(vinylbenzyl quaternary phosphonium) salt charge control agent having the structure:

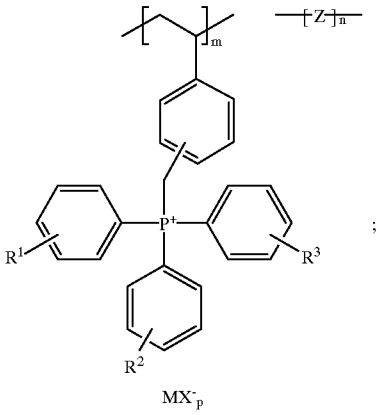

wherein

M represents Fe or Zn;

X represents F, Cl, Br or I;

p is 3 when M represents Zn and p is 4 when M represents Fe;

ortho, meta and para isomers of the vinyl benzyl moiety are included;

$R^1$, $R^2$ and $R^3$ represent hydrogen; alkyl having from 1 to 24 carbon atoms; hydroxy-; carboxy-; alkoxy-; carboalkoxy; acyloxy-; amino-; nitro-; cyano-; keto-; or halo-; and $R^1$, $R^2$ and $R^3$ may be independently substituted in the ortho, meta or para positions. $R^1$, $R^2$ and $R^3$ may represent more than one substituent per ring;

$\text{—}[Z]\text{—}$ represents a copolymerized comonomer selected from the group consisting of acrylamides, acrylic acid, acrylonitrile, alkyl acrylates, alkyl methacrylates, alkyl vinyl ethers, styrenes, maleic anhydride, methacrylamides, methacrylic acid, methylacrylonitrile, silyl methacrylates, vinyl esters, vinyl amides and vinyl halides and m and n together total 100 mole percent wherein m is 0.01 to 100.00 mole percent.

* * * * *